United States Patent [19]

Tate, Jr.

[11] 4,037,593

[45] * July 26, 1977

[54] SURGICAL MASK WITH VAPOR BARRIER

[75] Inventor: George W. Tate, Jr., Dallas, Tex.

[73] Assignees: Giles C. Clegg, Jr.; John R. Lynn, both of Dallas, Tex.

[ * ] Notice: The portion of the term of this patent subsequent to Aug. 17, 1993, has been disclaimed.

[21] Appl. No.: 635,970

[22] Filed: Nov. 28, 1975

[51] Int. Cl.[2] ..... A62B 7/10

[52] U.S. Cl. ..... 128/146.2; 128/139

[58] Field of Search ..... 128/146.2, 146.3, 146.6, 128/146.7, 146, 139, 141 R, 145.5, 145.6, 145.7, 132 R; 2/14 K

[56] References Cited

U.S. PATENT DOCUMENTS

| | | | |
|---|---|---|---|
| 3,316,903 | 5/1967 | Richards | 128/145.7 |
| 3,834,384 | 9/1974 | Raines | 128/146.2 |
| 3,888,246 | 6/1975 | Lauer | 128/146.2 |

FOREIGN PATENT DOCUMENTS

| | | | |
|---|---|---|---|
| 1,806,129 | 9/1969 | Germany | 128/146.2 |
| 1,002,447 | 8/1965 | United Kingdom | 128/146.2 |

*Primary Examiner*—Robert W. Michell
*Assistant Examiner*—Henry J. Recla
*Attorney, Agent, or Firm*—Giles C. Clegg, Jr. & Co.

[57] ABSTRACT

A surgical mask is provided with a vapor barrier for preventing clouding or fogging of optical aids or devices used by the wearer of the mask. The vapor barrier comprises a contoured strip of elongated soft closed cell foam material interposed between the upper edge of the mask and the wearer's face. The interposed material contours itself to and sufficiently extends over the wearer's face to form a seal and vapor barrier preventing fluid vapor exhausted from the wearer's nose and mouth from contacting spectacles, optical loupes or other optical instruments worn by the wearer and susceptible to clouding or fogging.

4 Claims, 3 Drawing Figures

SURGICAL MASK WITH VAPOR BARRIER

BACKGROUND OF THE INVENTION

The present invention relates to surgical face masks and more particularly to a mask having a vapor barrier for preventing clouding or fogging of optical aids used by a wearer of a surgical face mask.

Surgical face masks are worn by surgeons and others in operating and the like to substantially prevent the contamination or infection from airborne bacteria exhausted from the breath of the wearer. Surgical masks are generally lightweight in construction and contain several features designed for adaption to an individual wearer's features. There is often incorporated within the mask, along the upper edge, an elongated, deformable strip having sufficient stiffness to retain the shape given it. In this way, the upper portion of the mask may be contoured to the wearer's face to improve the upper edge fit. A relatively thin strip of soft foam material is sometimes found along this upper edge to increase the comfort of the wearer.

Although the upper edge may be contoured in a variety of facial shapes to most closely approximate the wearer's features, it is inadequate to prevent the wearer's breath from being vented between the face of the wearer and the mask. Since these masks are not designed to obstruct breathing, but rather to provide a breath filter, some breath exhausts through the upper portion of the mask into the vicinity of the wearer's eyes. The breath, being warm and moist, holds fluid vapor which readily condenses on cooler objects. Such cooler objects may be present in the airconditioned operating rooms in the form of glass lenses of optical aids used by the surgeons and assistants. Such optical aids include spectacles, surgicalloupes and surgical microscopes.

The exhaust of exhaled breath is resisted to some degree by the mask itself, promoting flow of breath under the mask edges. Because warm air rises, the wearers breath also has a natural tendency to rise under the upper mask edge and through the upper mask surface area producing fogging of the optical aids positioned in the vicinity of the wearer's eyes. This obscuration of the wearer's vision is a nuisance at best and a hazard at worst. This shortcoming of the prior art mask often requires the surgeon to pause to clear the lenses of condensation interfering with his or her vision. The necessity for clear vision during surgical procedures as well as the time expediency element has fostered a need for preventing such fogging.

SUMMARY OF THE INVENTION

One object of the present invention is to provide a new and improved means for preventing the fogging of optical aids used by wearer of a face mask.

Another object of the present invention is to provide a new and improved means for substantially reducing the amount of wearer's breath which rises through a surgical face mask in the vicinity of the wearer's eyes.

It is a further object of the present invention to provide a new and improved means for sealing a surgical face mask against the wearer's face to prevent the rise of the wearer's breath in the vicinity of the wearer's eyes.

It is a further object of the present invention to provide a surgical mask with a contouring seal along the upper edge thereof which substantially prevents the rising of the wearer's breath from beneath the face mask around the vicinity of the wearer's eyes.

A new and improved surgical mask, in accordance with the principles of the present invention, includes an elongated cushioning element interposed between the upper mask edge and the wearer's face and a strip of deformable material secured along the upper edge of the mask of sufficient retentivity to retain its shape upon deformation and compress the cushioning element to form a seal. The cushioning element covers a sufficient portion of the upper part of the mask to prevent fluid vapor in the wearer's breath from reaching the vicinity of the wearer's eyes. The cushioning element is contoured to provide better sealing characteristics and facilitate down-vision.

DESCRIPTION OF THE DRAWINGS

Many objects and advantageous features of the present invention will be understood from the following detailed description thereof when read in conjunction with the accompanying drawings, wherein.

DETAILED DESCRIPTION

Figure 1:
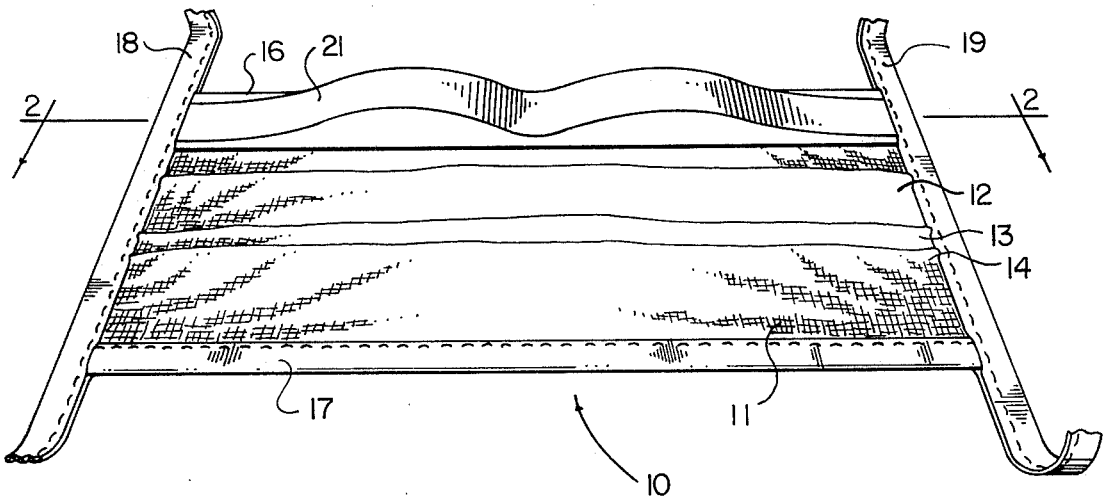
FIG. 1 is a perspective view of a surgical face mask provided with a vapor barrier for eliminating the fogging of optical aids.

Attention is first directed to FIG. 1 wherein a surgical face mask 10 is shown having a rectangular shape and formed of a body 11 including one or more layers of high efficiency filter material. The filter construction allows the inhalation and exhaustion of air therethrough while preventing the passage of airborne bacteria. The mask 10 may be of the laminated type including a soft inner liner of filter material and a durable, thin outer cover. It may be folded to form pleats 12–14 which unfold to provide sufficient room for expanding around the wearer's nose and chin to better conform the mask to the wearer.

The upper and lower peripheral edges of the body 11 are bounded by first and second trimming strips 16 and 17, respectively, which are preferably attached to the body 11, for example, by sewing them thereto. Left and right peripheral edges of the body 11 are bounded by the central portions of first and second tie strips 18 and 19, respectively, for securing the mask 10 to the wearer's face. The central portions of the tie strips 18 and 19 are attached to the left and right peripheral edges of the body 11, for example, by sewing them thereto.

Figure 2:
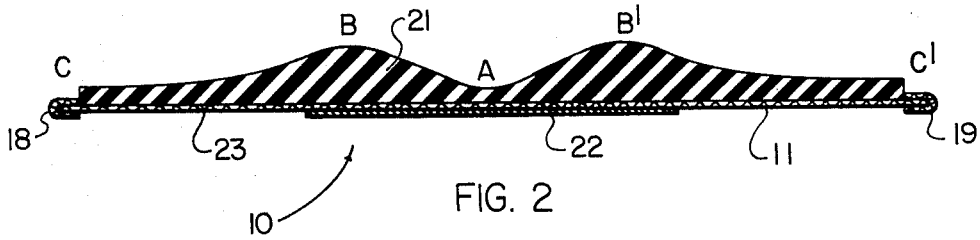
FIG. 2 is a cross-sectional view taken along the lines 2—2 of FIG. 1.

Attention is next directed to the upper edge of the mask 10 wherein a vapor barrier as most clearly shown in FIG. 2 is attached, and includes a strip 22 of malleable material bonded to the outside surface of the body 11 of filter material opposite to the central portion of an elongated cushioning strip 21 formed from substantially closed-cell foam plastic material, for example, polyurethane ether or ester foam material having 90% closed cells of approximately 4–5 pores/cm$^2$ and a density of approximately 0.04 gm/cm$^3$.

As shown clearly in FIG. 2 the strip 21 is symmetrical and includes a central portion A of minimum thickness, for example, from 0.25 to 0.4 cm., adjacent to which are left and right intermediate portions B and B$^1$, respectively, of maximum thickness, for example, from 1.0 to 1.3 cm, and distal portions C and C$^1$, respectively, having a thickness of approximately 0.4 – 0.6 cm. The strip 21 is preferably planar on one side 23, which is affixed to the filter material at the upper inside edge of the mask 10 adjacent and parallel to the trimming strip 16, preferably by a suitable non-allergenic adhesive.

The strip 21 extends substantially along the full length of the upper edge of the mask 10 and is of a width sufficient to form an effective moisture barrier between the wearer's nose and mouth and the vicinity of the wearer's eyes. A width of approximately 1.6 cm. has been found sufficient to restrict flow of vapors through either the upper portion of the mask or between the skin and the mask for preventing fogging of optical aids. The strip 21 has a generally rectangular cross-sectional shape and preferably has high compressibility to conform to the contours of the wearer's nose and cheekbones. The central portion A of the cushion 23 and the left and right intermediate portions B and $B^1$ can thus be contoured around the vicinity of the bridge of the wearer's nose and the wearer's cheekbones when in use.

Figure 3:
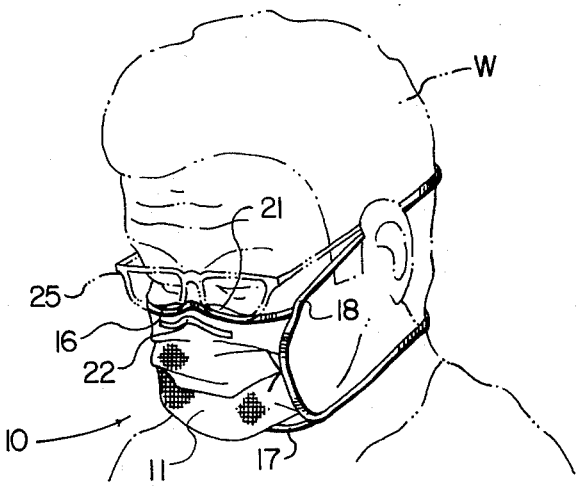
FIG. 3 is a perspective view of the mask of FIG. 1, positioned on a wearer's face outlined in phantom.

As shown in FIG. 3, the mask 10 is secured to a wearer W in the usual fashion. The elongated tie strips 18 and 19 which form the side edges of the mask 10 (FIG. 1) hold the mask 10 against the face of the wearer W. The tie strips 18 and 19 are fastened sufficiently tight that when the strip 22 is deformed the strip 21 will be held in a snug, contoured shape across the upper portion of the wearer's face beneath the wearer's eyes to produce a moisture seal between the upper edge of the mask 10 and the wearer's face.

The shape and dimensions of the foam strip are basically a function of the compressability of the foam.If a highly compressable foam is used, little or no contouring is necessary, whereas with very stiff foams, the strip must be highly contoured. Whatever combination of foam and contouring is chosen, when the mask attached to the face as shown in FIG. 3, by tie strips 18 and 19 in a comfortable fashion and with it completely formed to the extent possible by the maleable strip 22, the mask may not protrude any further forward than a line directed 45° inferiorly from the optical axis of the eye when the gaze is directed straight ahead. This is a maximal boundary and it is preferred that a line 60° from the optical axis of the eye be the limit.

The distal portions C and $C^1$ of the cushion 23 taper in thickness from the portions B and $B^1$ and are of reduced thickness to increase the applied compressive force in the center of the mask 10 and facilitate the down-vision of the wearer in this area. The forces holding the mask 10 to the wearer's face are thus more uniformly distributed across the upper edge of the mask 10 by providing such a contour and seal.

An effective contour is defined by relating cushion 21 thickness to its maximum thickness. In accordance with one specific example of the invention, a thickness variation of one-third maximum thickness at the central portion A has proven to be suitable to accommodate the wearer's nose. A thickness variation of one-third maximum thickness at the distal portions C and $C^1$ has proven to be effective to eliminate interference with the wearer's down-vision in this area. The contoured shape of cushion 23 thus accommodates the basic facial structure of the average wearer to enhance the individually conforming and sealing qualities of the moisture barrier.

The malleable strip 22 is affixed to the filter material 11 opposite the cushion 23, for example, by bonding thereto by a suitable adhesive. The strip 22 is readily deformable and yet of sufficient retentivity to maintain the shape given it for the necessary compression of the cushion 21. Slight pressure applied by the wearer's fingers deforms strip 22 about the nose of the wearer conforming the cushion 21 to the wearer's individual cheek and nose bone contours. By securely fastening the mask 10 to the wearer's face by the tie strips 18 and 10, the contoured strip 22 then provides the necessary compressive force to the cushion 23 forming the desired vapor or moisture seal between the wearer's nose and mouth and the wearer's eyes.

The operation and construction of the above-described invention will be apparent from foregoing description. While a particular embodiment has been shown and described, it will be obvious that various changes and modifications may be made therein without departing from the spirit and scope of the invention as defined in the following claims.

What is claimed is:

1. In an improved surgical mask of the type comprising a main body member including at least one layer of a filtering matèrial, said main body having upper, lower and side edges, an upper region, a lower region and securing means extending laterally from the opposite edges for securing the mask over the face of a wearer to cover the nose and mouth, the improvement comprising;

an elongated strip of deformable, closed cell foam material having upper and lower edges and adaptable to the contours of the nose and cheek bones of the wearer attached to the inner surface of the upper region of the mask with the upper edge extending substantially across the entire upper edge of said main body, and being of sufficient width between the upper and lower edges to prevent flow of vapor through the upper region of the main body in the vicinity of optical aids used by the wearer of the mask, and deformable means for assisting in maintaining a desired contour to said strip and holding said strip against the wearer's face in sealing relationship.

2. The mask of claim 1 wherein said strip of deformable closed-cell foam material is symmetrical and is formed with a central portion of minimum thickness, first and second intermediate portions of maximum thickness adjacent to and on opposite sides of said central portion, and first and second distal portions, of intermediate thickness respectively, spaced from said intermediate portions.

3. The mask of claim 2 wherein the minimum thickness is approximately one-third of the maximum thickness.

4. The mask of claim 1 wherein said deformable means includes a deformable strip of shape retentive material parallel to and spaced from said elongated strip of foam material.

* * * * *